US006045559A

United States Patent [19]

Sueyoshi et al.

[11] Patent Number: 6,045,559

[45] Date of Patent: Apr. 4, 2000

[54] EPILATING DEVICE FOR REMOVAL OF BODY HAIRS

[75] Inventors: Hidekazu Sueyoshi, Shiga; Jyuzaemon Iwasaki, Nagahama; Toshihiro Takeuchi, Hikone; Tetsuro Hashiguchi, Hikone; Hitoshi Ogawa, Hikone, all of Japan

[73] Assignee: Matsushita Electric Works, Ltd., Osaka, Japan

[21] Appl. No.: 09/290,585

[22] Filed: Apr. 13, 1999

[30] Foreign Application Priority Data

| | | | |
|---|---|---|---|
| Apr. 15, 1998 | [JP] | Japan | 10-105157 |
| May 26, 1998 | [JP] | Japan | 10-144860 |
| Oct. 26, 1998 | [JP] | Japan | 10-304008 |

[51] Int. Cl.[7] ..... A45D 26/00

[52] U.S. Cl. ..... 606/133; 606/131

[58] Field of Search ..... 606/131, 133

[56] References Cited

U.S. PATENT DOCUMENTS

| | | | |
|---|---|---|---|
| 4,923,463 | 5/1990 | Nussbaum . | |
| 5,057,116 | 10/1991 | Zucker | 606/133 |
| 5,078,715 | 1/1992 | Daar et al. | 606/133 |
| 5,084,056 | 1/1992 | Eckel et al. . | |
| 5,088,999 | 2/1992 | Bukoschek et al. | 606/133 |
| 5,100,413 | 3/1992 | Dolev | 606/133 |
| 5,163,288 | 11/1992 | Dolev | 606/133 |
| 5,261,919 | 11/1993 | Niedertsch et al. | 606/133 |
| 5,356,415 | 10/1994 | Iwasaki et al. | 606/133 |
| 5,849,018 | 12/1998 | Rosson et al. | 606/133 |

FOREIGN PATENT DOCUMENTS

| | | |
|---|---|---|
| 0630596A1 | 12/1994 | European Pat. Off. . |
| 0861615A2 | 9/1998 | European Pat. Off. . |
| 2668902 | 5/1992 | France . |
| 4427788A1 | 2/1996 | Germany . |
| WO 93/04608 | 3/1993 | WIPO . |
| WO 95/07638 | 3/1995 | WIPO . |

*Primary Examiner*—Paul J. Hirsch
*Attorney, Agent, or Firm*—Nikaido, Marmelstein, Murray & Oram, LLP

[57] ABSTRACT

An improved epilating device is capable of effectively removing the hairs at different skin portions of the human body. The epilating device includes a single housing which is shaped to be grasped by the hand of a user and which includes a drive source. The housing carries a first epilation module provided at its top with a first plucking head which is driven by the drive source to effect the plucking of the body hairs. The first plucking head has a length defining therealong a first epilation zone. Also carried on the housing is a second epilation module provided at its top with a second plucking head which is driven commonly by the drive source to effect plucking of the body hairs. The second plucking head has a length defining therealong a second epilation zone. The first and second epilation modules are shaped respectively to have individual top ends of different external dimensions along the lengths of the first and second plucking heads and to have the first and second epilation zones of different lengths. Thus, the first and second epilation module can be selected depending upon the intended skin portion for optimum hair plucking at that portion.

18 Claims, 14 Drawing Sheets

30
32
110
20
32
31
93
92
93
123
124
126
25
93
91
90
91
91
90
125
121
122
80
22
81
23
21
28
120

62
63
64
60
67
65
68
66
69
52
52
53
51
53
31
32
75
35
36
34
38
73
72
70
37
70
72
71
33
35
39
75
50

252
231
340
225
262
274
273
270
273
270

EPILATING DEVICE FOR REMOVAL OF BODY HAIRS

BACKGROUND OF THE INVENTION

1. Field of the Invention

The present invention is directed to an epilating device for removal of body hairs, and more particularly to such epilating device for removing the hairs on different skin portions.

2. Description of the Prior Art

As disclosed in U.S. Pat. Nos. 4,923,463 and 5,084,056 which propose epilating devices of various head configurations, attempts have been made to improve hair plucking efficiency. In view of the fact that the body hairs to be removed are distributed on different skin portions including a relatively wide area such as arms and legs, and a relatively small restricted area such as armpits, however, the prior art devices are not yet satisfactory in removing the hairs effectively with the use of a single epilation head because of its limited accessibility to the particular area.

SUMMARY OF THE INVENTION

The present invention has been accomplished in view of the above problem to provide an improved epilating device which is capable of effectively removing the hairs at different skin portions of the human body. The epilating device of the present invention includes a single housing which is shaped to be grasped by the hand of a user and which includes a drive source. The housing carries a first epilation module provided at its top with a first plucking head which is driven by the drive source to effect the plucking of the body hairs. The first plucking head has a length defining therealong a first epilation zone. Also carried on the housing is a second epilation module which is provided at its top with a second plucking head which is driven commonly by the drive source to effect plucking of the body hairs. The second plucking head has a length defining therealong a second epilation zone. The first and second epilation modules are shaped respectively to have individual top ends of different external dimensions along the lengths of the first and second plucking heads and to have the first and second epilation zones of different lengths. Thus, the first and second epilation modules can be selected depending upon an intended skin portion for optimum hair plucking at that portion.

Accordingly, it is a primary object of the present invention to provide an epilating device which is capable of effective hair plucking for any particular skin portions including the relatively wide portion such as the legs and the arms, and a small restricted area such as the armpits.

Preferably, the first and second epilation modules are detachable to the common housing so as to be selectively mounted thereto. In this regard, the housing includes a drive gear connected to the drive source, while the first and second epilation modules include first and second driven gears, respectively which are engageable with the common drive gear so as to actuate the first and second plucking heads.

Each of the first and second plucking heads includes a series of blades arranged to have a gap between the adjacent blades for pinching the hairs in the gap. It is preferred that the gap of the first plucking head is made smaller than that of the second plucking head in order to have the increased number of the blades or gaps within a limited length for effective hair plucking at the restricted skin portion.

The first epilation module may include a pair of the first plucking heads which are disposed to be capable of simultaneous contact with the skin, while the second epilation module includes only one the second plucking head. In this case, the first plucking head is designed to have the first epilation zone of which length is smaller than that of the second epilation zone of the second plucking head. Despite of the smaller length given to the first epilation zone of the first epilation module for optimum use in the restricted skin portions, the combination of the two first plucking heads can improve an overall plucking efficiency of the two first epilation modules.

It is also preferred that the two first plucking heads are arranged to effect the hair plucking at different timings. Thus, the hair plucking can be made alternately at the two plucking heads at a less load to a driving source or motor than in the case when the hair plucking is made simultaneously at the two plucking heads, reducing a power requirement for the epilating device.

In a preferred embodiment, each of the first plucking heads is defined by a plucking cylinder having a longitudinal axis and being provided with at least two rows of blades arranged along the longitudinal axis for pinching the hairs between the adjacent blades of each row. The plucking cylinder is driven to move about the longitudinal axis for plucking from the skin the hairs pinched between the blades. The plucking cylinder further includes a skin stretcher which is disposed between the two rows of the blades around the circumference of the plucking cylinder in order to smooth the skin immediately prior to plucking the hair therefrom and therefore effect the hair plucking effectively with less pains.

In the plucking system where the two first plucking heads are arranged in parallel with each other, it is preferred to move the plucking cylinder about the individual longitudinal axes in such a manner as to effect the pinching of the hairs by one of the plucking cylinders while bringing the skin stretcher of the other plucking cylinder into contact with the skin at the same time. Thus, the hair plucking can be made alternately at the two plucking cylinders at a less load required for the motor than in the case when the hair plucking is made simultaneously at the two plucking cylinders, reducing a power requirement for the epilating device.

Also in the above system, the second epilation module is preferred to include the only one second plucking head having a second longitudinal axis to be movable thereabout for plucking the hairs. The two first plucking heads of parallel arrangement are driven to move respectively about a first longitudinal axes in opposite directions at the time of plucking the hairs, while the second plucking head being are driven to move about a second longitudinal axis only in one direction at the time of plucking the hairs. Thus, the two first plucking heads can be cooperative to effect successful plucking of hairs oriented in different directions as seen on the armpits, while the second plucking head is effective for plucking the hairs oriented in generally one direction as seen on the legs or arms.

The first plucking heads are driven to move by a single drive source, i.e., motor and respectively through separate transmission gear trains which are disposed on opposite longitudinal ends of the first plucking heads. With this dispersion of the transmission gear trains on both longitudinal ends of the plucking cylinders, it is possible to minimize a spacing or wall thickness measured from the longitudinal ends of the first plucking head to an adjacent exterior surface of an enclosure, facilitating to place the plucking cylinders in well conformity with an armpit or the like restricted portion of the human body, and therefore increasing the hair epilating efficiency at that portion. Also, the above dispersion of the transmission gear trains is effective to mitigate associated noises perceived to the user.

Preferably, a skin smoother is disposed between the two first plucking heads to come into contact with the user's skin for pressing a portion of the skin confined between the two first plucking heads. Thus, the skin smoother can avoid an excessive elongation of the skin portion confined between the two first plucking heads while plucking the hairs therefrom, thereby alleviating pains of plucking the hairs.

An overload clutch may be provided in a drive transmission path leading from the motor to the first plucking heads for protecting the motor and a transmission mechanism against possible entanglement of foreign matters in or around the first plucking heads.

In the preferred embodiment where the first plucking head is defined by the plucking cylinder, the cylinder includes a holder which carries a series of blades arranged side-by-side along an axis parallel to the longitudinal axis of the cylinder. The blades including at least one movable blade which is cooperative with the adjacent one of said blades to form a gap therebetween. The holder is provided with at least one fulcrum for pivotally supporting the movable blade so that the movable blade pivots about a pivot axis perpendicular to the longitudinal axis to close and open the gap for pinching the hairs between the gap. The movable blade is connected to an actuator reciprocating along the longitudinal axis so as to be caused thereby to pivot for closing and opening said gap. The holder and the actuator are integrated into a hair-pinching unit which is subsequently mounted to the plucking cylinder. Thus, almost all of the parts responsible for closing and opening the gaps to effect the hair pinching operation can be integrated into the separate hair-pinching unit for easy assembly into the plucking cylinder. With this consequence, the parts of the hair-pinching unit can be designed rather independently of the first plucking cylinder and vice versa, thereby enabling to make a small-sized epilation head composed of the plucking cylinder and the hair-pinching unit.

The plucking cylinder is preferred to carry at least two hair-pinching units which are circumferentially spaced about the longitudinal axis in parallel relation to each other. In this instance, the blades in each of the hair-pinching units are composed of at least two pairs of movable blades and at least two fixed blades with anyone of the fixed blades being interposed between the two movable blades in each pair to form the gap between each of the movable blades and the fixed blade. The fixed blades in one of the hair-pinching units are staggered along the longitudinal axis with respect to the fixed blades in the other hair-pinching unit. Thus, the gaps of the two units responsible for entrapping the hairs can cover an intended area of the skin in such a manner as to minimize or eliminate a dead-zone not available for entrapping the hairs along the length of the intended area, thus increasing hair epilation efficiency.

Further, in the plucking cylinder having at least two hair-pinching units, a toggle element is provided to interlock the actuators of the hair-pinching units such that the actuator's movement of closing said gap in one hair-pinching unit is transmitted the actuator's movement of opening said gap in the other hair-pinching unit. Thus, the system can eliminate the use of a return spring for opening the gap subsequent to closing the gap by the actuator, thereby simplifying the structure of the epilating device and enabling easy miniaturization of the device.

In the preferred embodiment where the movable blade is driven by the reciprocating actuator to pivot for pinching the hairs, the actuator engages with a cam wheel and is caused by the cam wheel to reciprocate for pivoting the movable blade in response to the movement of the plucking cylinder about the longitudinal axis. The actuator is biased by a spring into pressed contact with the cam wheel. The bias of the spring is restricted by a restricting mechanism for limiting a contacting pressure at which the cam wheel is pressed against the actuator. Thus, the actuator can be kept in constant contact with the cam wheel at an optimum pressure, assuring a smooth and reliable operation of translating the rotary motion of the plucking cylinder to the pivotal movement of the movable blades.

These and still other objects and advantageous features of the present invention will become more apparent from the following description of the embodiments when taken in conjunction with the attached drawings.

DETAIL DESCRIPTION OF THE INVENTION

Figure 1:
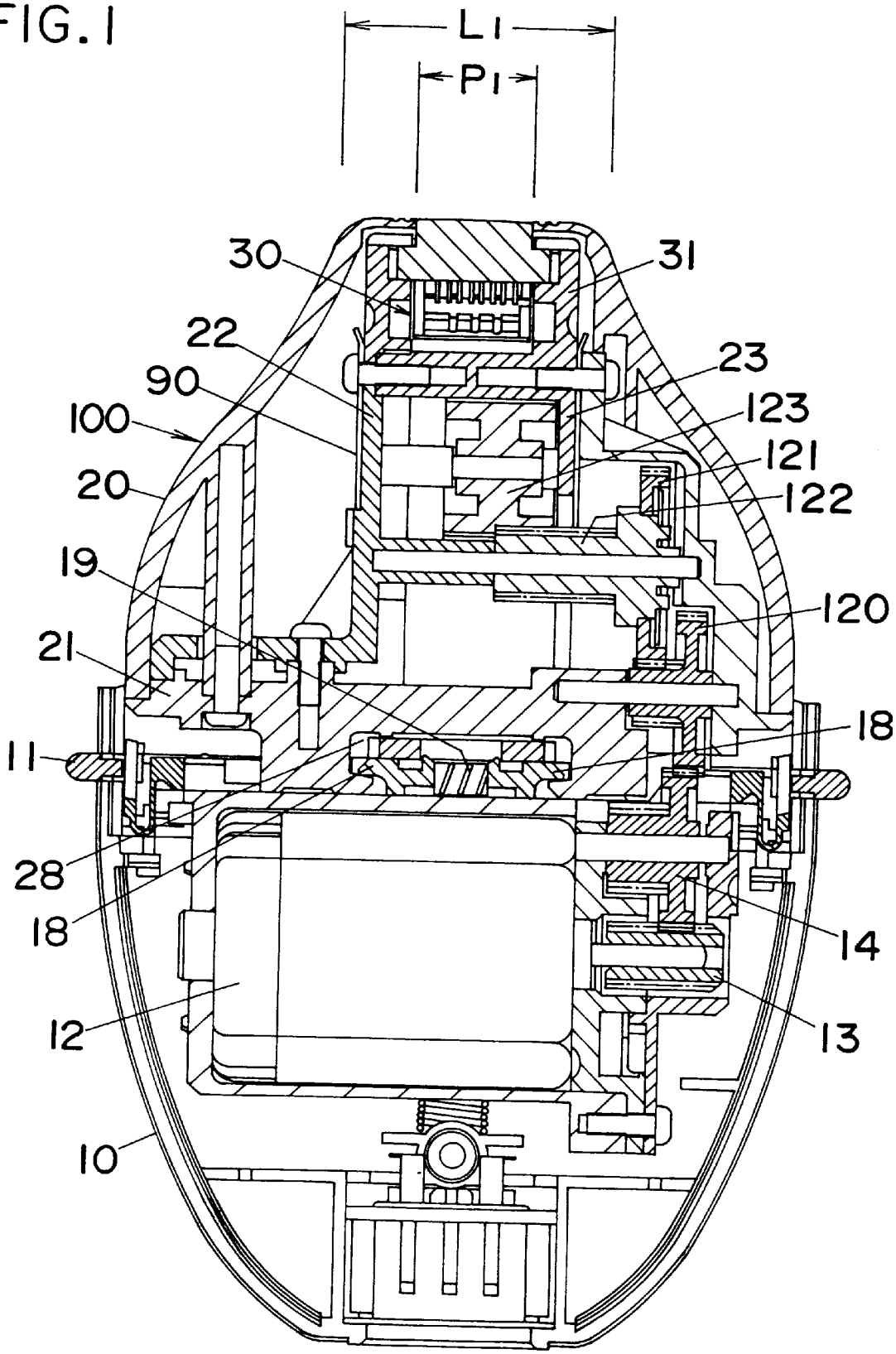
FIG. 1 is a vertical section of an epilating device in accordance with a preferred embodiment of the present invention.
Figure 2:
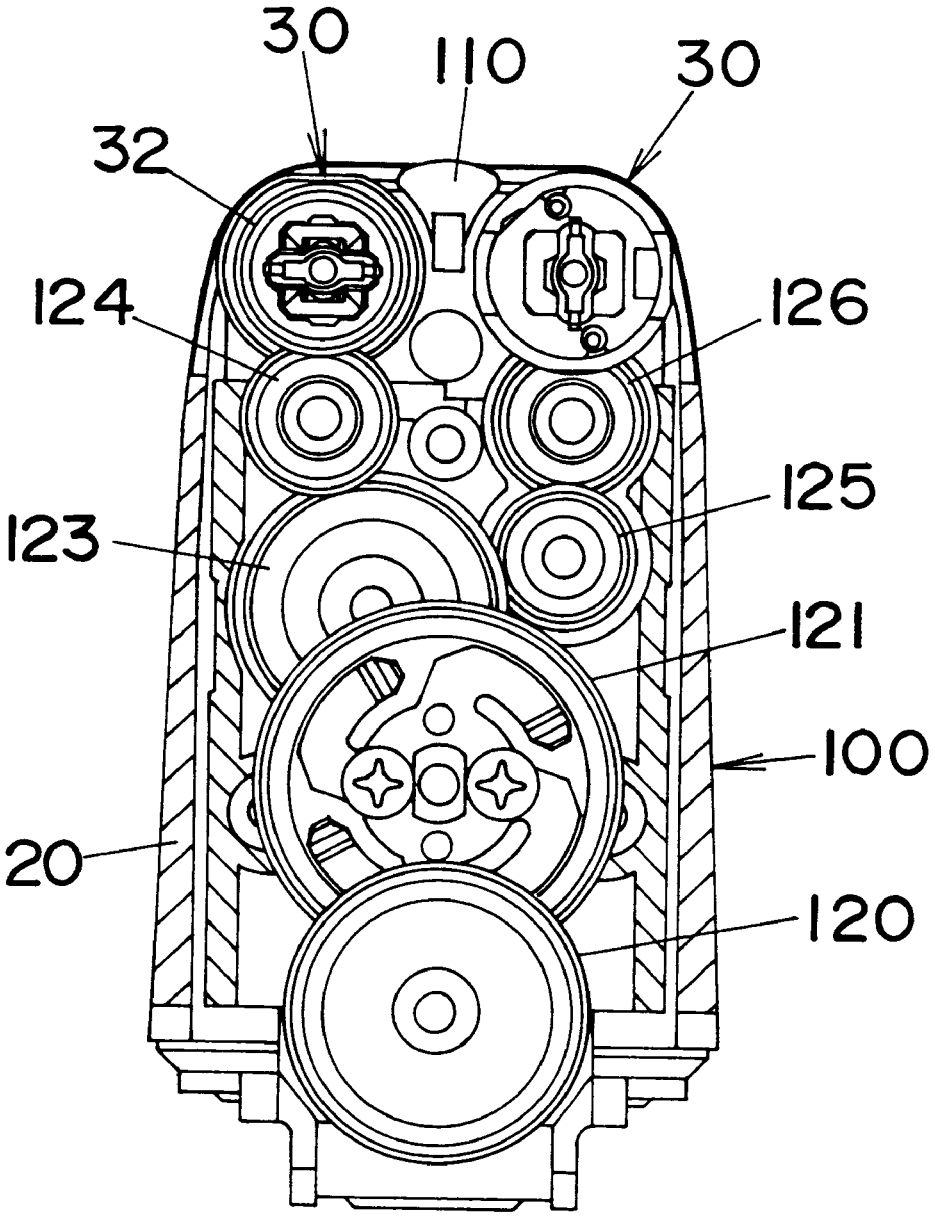
FIG. 2 is another vertical section of a portion of the epilating device.
Figure 3:
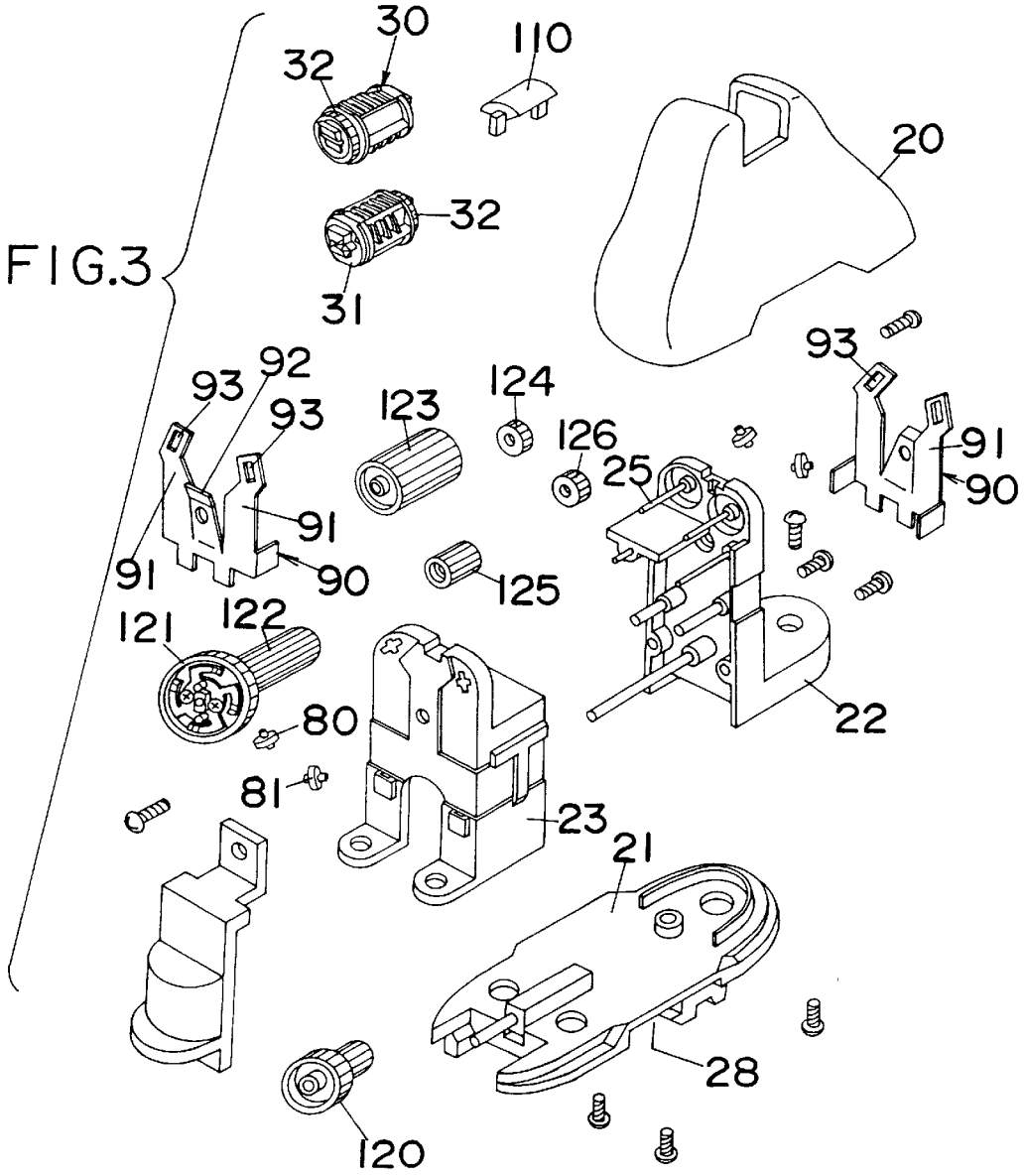
FIG. 3 is an exploded perspective view of the epilating device.

Referring now to FIGS. 1 to 3, there is shown an epilating device in accordance with a preferred embodiment of the present invention. The epilating device has an epilation module 100 composed of a head frame 20 mounting a pair of plucking heads 30 of the identical configuration. The epilation module or the frame 20 is detachable to a base shell 10 or housing incorporating therein a motor 12 as a drive source and provided with a power switch. The plucking heads 30 are mounted on top of the frame 20 in parallel with each other and driven to rotate about individual longitudinal axes thereof by the motor 12 and through a transmission line. The transmission line includes a drive gear 14 which meshes with an output gear 13 of the motor 12 and which is exposed on top of the base shell 10 for detachable engagement with a driven gear 120 held in the head frame 20. The driven gear 120 is connected through a set of gears 121 to 126 to individual gear 32 on one longitudinal end of each plucking head 30 to rotate the plucking heads 30 in the opposite directions.

As best shown in FIG. 3, the head frame 20 includes a bottom plate 21 on which a pair of brackets 22 and 23 are fixed. A pair of parallel pins 25 bridges between the top ends of the brackets to support the plucking heads 30 respectively in such a manner that the plucking heads are freely rotatable about the pins. The gears 121 to 126 are supported by corresponding pins also bridging between the brackets. The driven gear 120 is supported by a pin at one end of the bottom plate 21. The bottom plate 21 is formed in its lower surface with a catch recess 28 for detachable mechanical engagement with a pair of latches 18 which project on top of the base shell 10 and are biased by a spring 19 in a direction of keeping the engagement of the latches 18 with the catch recess 28. The head frame 20 or the epilation module 100 is detached from the base shell 10 by pushing buttons 11 projecting on the upper sides of the base shell. When pushed, the buttons 11 move the latches 18 against the spring 19 inwardly to disengage the latches 18 from the catch recess 28.

Figure 4:
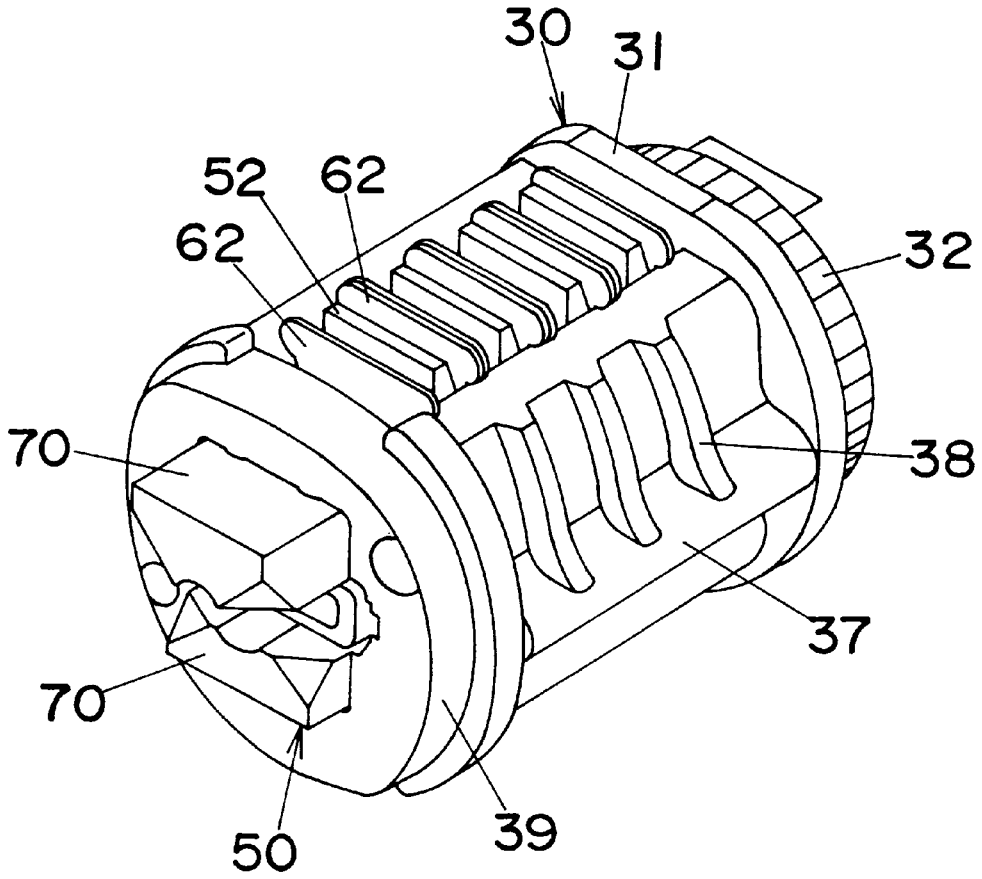
FIG. 4 is a perspective view of a plucking head of the epilating device.
Figure 5:
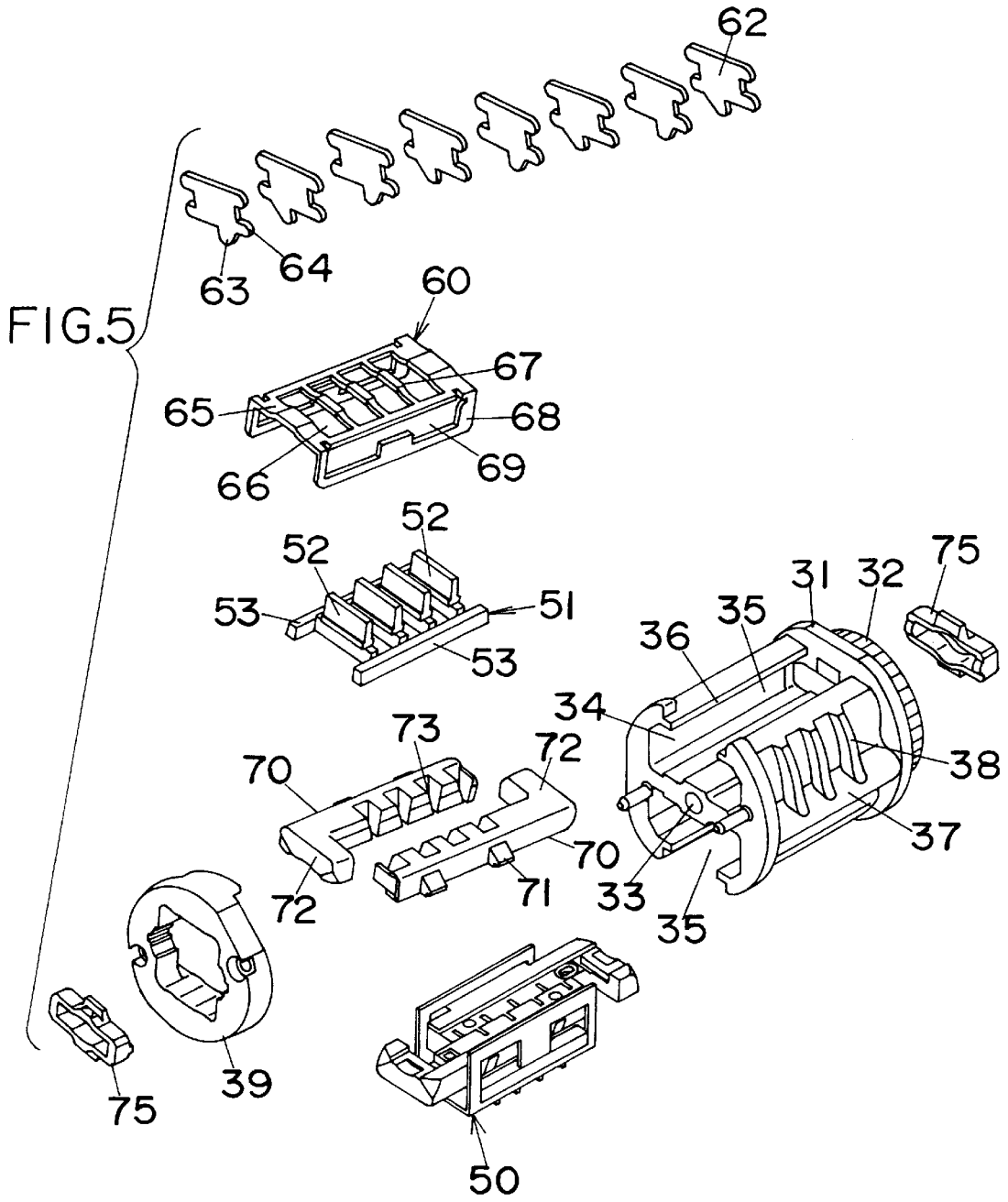
FIG. 5 is an exploded perspective view of the plucking head.
Figure 6:
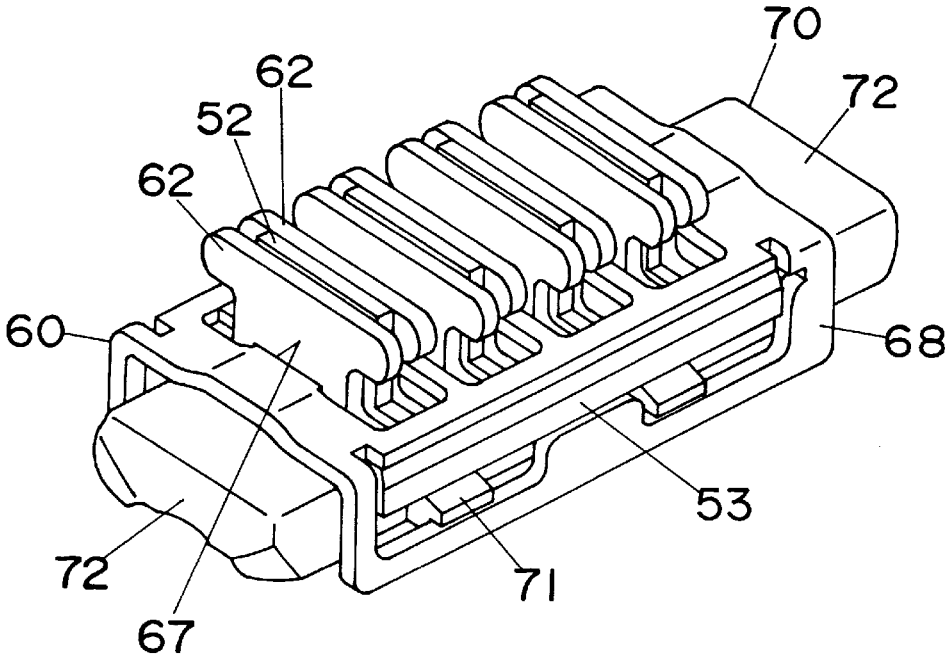
FIG. 6 is a perspective view of a hair-pinching unit of the plucking head.
Figure 7:
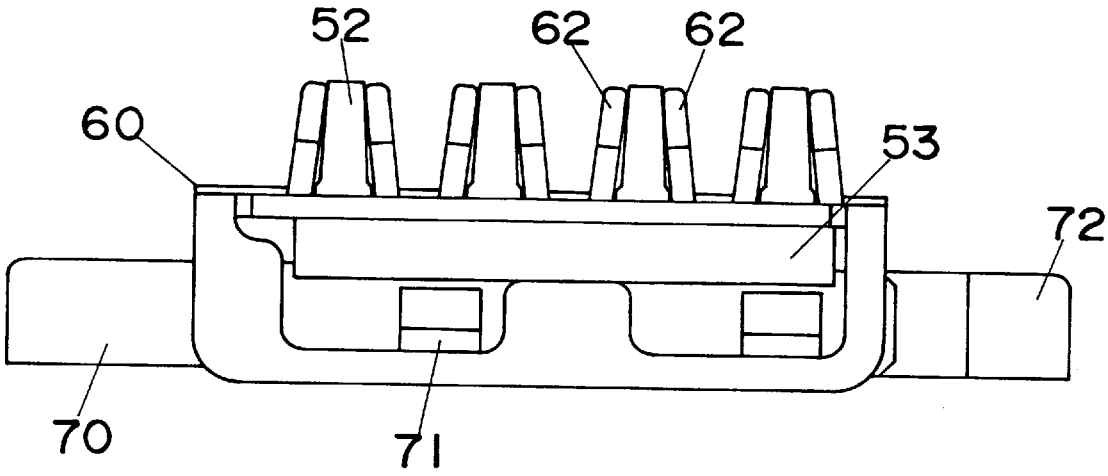
FIG. 7 is a front view of the hair-pinching unit.

As shown in FIGS. 4 to 6, each of the plucking head 30 is composed of a plucking cylinder 31 and a pair of hair pinching units 50. The cylinder 31, which is a one-piece molded part formed with the gear 32 at one longitudinal end thereof, has a center bore 33 for receiving therein the pin 25 as well as a pair of diametrically opposed axial slots 34 running parallel to the longitudinal axis of the cylinder for receiving therein each one of the hair-pinching units 50. Each axial slot 34 opens in the circumference of the cylinder 31 to define thereat an axially elongated window 35, and also opens in one longitudinal end of the cylinder. The cylinder 31 is also formed with a combination of a skin stretcher 37 and a comb 38 on each circumferential portion between the windows 35.

Figure 8:
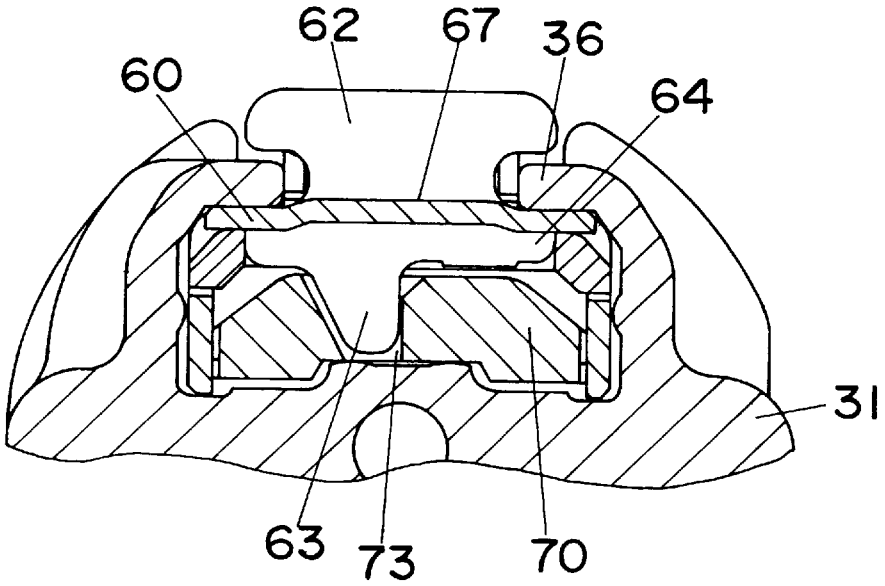
FIG. 8 is a sectional view of the hair-pinching unit assembled into the plucking head.

The hair-pinching unit 50 carries a series of fixed blades 52 and movable blades 62 for pinching body hairs in gaps between the movable blades 62 and the adjacent fixed blades 52. The unit 50 includes a base 51, a frame 60, and an actuator composed of two sliders 70. The base 51 is molded from a plastic material to integrally have the fixed blades 52 spaced uniformly and held between a pair of parallel beams 53 also integral with the base. The frame 60, which is provided for pivotally supporting the movable blades 62, is shaped from a thin metal sheet to have a generally U-shaped section with a pair of legs 68 depending from a top plate 65. The top plate 65 has an array of parallel slits 66 through which the fixed blades 52 and the movable blades 62 project. On opposite edges of each slit 66 there are formed raised pivot edges 67 which, as best shown in FIGS. 8 and 9, give fulcrums to the associated movable blades 62, so that the movable blades 62 can pivot about an axis perpendicular to the length of the hair-pinching unit, i.e., perpendicular to the longitudinal axis of the plucking cylinder 31, as the sliders 70 oscillates to move the lower ends of the movable blades along the length of the unit.

Figure 9:
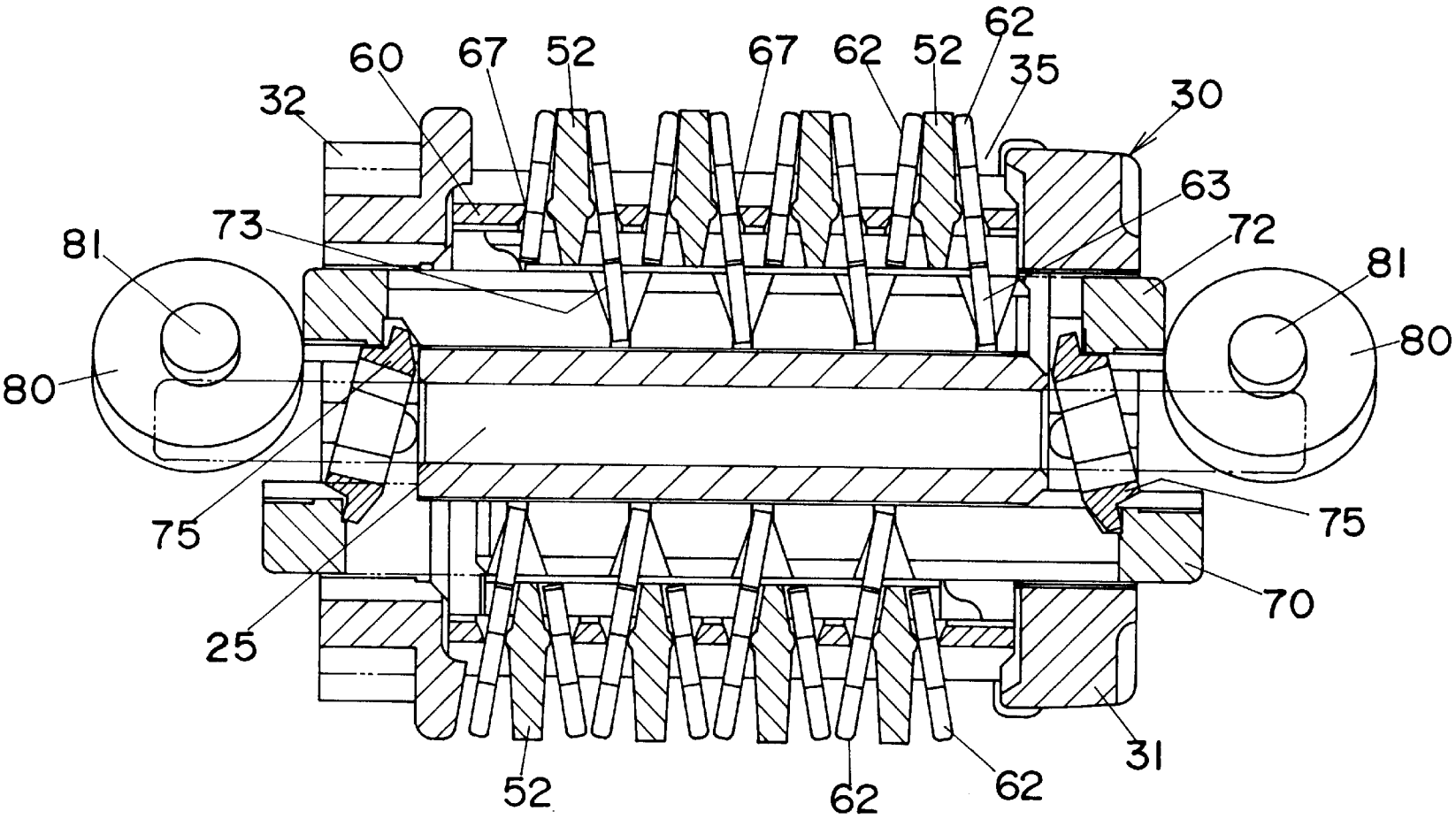
FIG. 9 is a vertical section of the plucking head.

As seen in FIG. 9, each slit 66 is responsible for passing therethrough a set of the one fixed blade 52 and the two movable blade 62 on opposite of the fixed blade 52 so that each of the two movable blades 62 defines a gap with the common fixed blade 52 for receiving the body hairs and pinching the same as the movable blade 62 pivots about the pivot axis defined by the pivot edge 67. The frame 60 is secured to the base 51 with the beams 53 of the base tightly fitted in the upper portions of openings 69 in the legs of the frame 60. A set of alternate ones of the movable blades 62 are connected to one of the sliders 70, while the other set of the remaining alternate ones of the movable blades 62 are connected to the other slider 70. The connection of the movable blade 62 to the slider 70 is made by engaging a bottom tab 63 of the blade into a corresponding notch 73 in the slider 70. The sliders 70 are supported by the frame 60 with guide projections 71 being slidably fitted in the lower portion of the opening 69 in the frame 60. Thus, the base 51 with the fixed blades 52, the movable blades, the frame 60 and the sliders 70 can be integrated into the hair pinching unit 50 which is assembled into each of the axial slots 34 of the plucking cylinder 31 to obtain the plucking head 30. Formed on the lateral edges of each window 35 of the plucking cylinder 31 are radial stoppers 36 which project inwardly to engage with the lateral ends of the frame 60 to retain the hair-pinching unit 50 in a fixed position with respect to the radial direction of the plucking cylinder 31, as best shown in FIG. 8. Also, the radial stoppers 36 engage with side tabs 64 of the movable blades 62 to retain the movable blades in the plucking cylinder 31. It is noted in this connection that the fulcrum, i.e., the pivot edge 67 is offset radially outwardly from a point of engagement between the radial stopper 36 and the frame 60. This is effective to give a sufficient distance between the pivot edge 67 and a driving connection of the actuator to the bottom tab 63 of the movable blade, within a limited height of the movable blade and therefore give an increased mechanical advantage in a pivot system for effectively gripping the hairs with less power requirement. As shown in FIG. 5, an axial stopper 39 in the form of a ring is secured to one longitudinal end of the cylinder 31 to retain both of the hair pinching units 50 in the cylinder due to abutment of the stopper 39 against the longitudinal end of each frame 60.

Each of the sliders 70 is formed at its one longitudinal end with a lever 72 which projects axially outwardly through the axial stopper 39 or through an end wall of the cylinder 31, where the gear 32 are formed, to be capable of coming into contact with each corresponding one of cam wheels 80 disposed on opposite sides of the plucking head 30, as shown in FIG. 9. The cam wheels 80 are supported respectively to the brackets 22 and 23 to be freely rotatable about respective pins 81. As the plucking head 30 rotates about its longitudinal axis, the levers 72 of the two sliders 70 in the one hair-pinching unit 50 come into contact with the respective cam wheels 80 so that the sliders 70 are displaced axially inwardly of the plucking head 30, thereby pivoting the movable blades 62 to close the gap, as seen in the upper part of FIG. 9, for pinching the hairs between the fixed blades 52 and the two adjacent movable blades 62. The sliders 70 of the one hair-pinching unit 50 are interlocked to the sliders of the other hair-pinching unit 50 respectively by means of toggle elements 75, as shown in FIGS. 5 and 9. Each of the toggle elements 75 engages at its one end with the lever 72 of each slider 70 in the one hair-pinching unit and engages at the other end with the lever 72 of each slider 70 in the other hair-pinching unit 50 such that the axially inward movement of the sliders 70 given by contact with the cam wheels for the one hair-pinching unit 50 is converted into the axially outwardly movement of the sliders in the other hair-pinching unit 50, thereby pivoting the movable blades 62 in the other hair-pinching unit to open the gaps, as seen in the lower part of FIG. 9.

Figure 11:
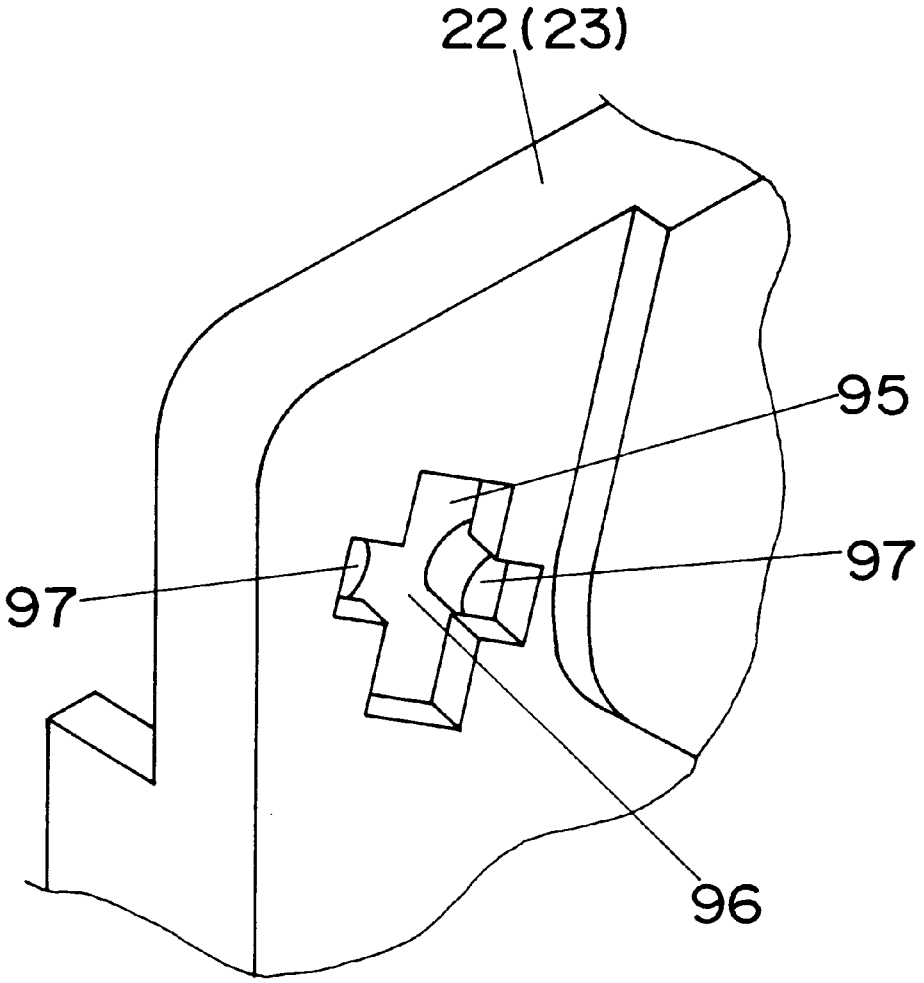
FIG. 11 is a perspective view of a portion of an internal structure of the epilating device.

In order to provide a positive contact between the sliders 70 and the cam wheels 80, spring attachments 90 are utilized to urge the cam wheels 80 towards the levers 72 of the sliders 70, as shown in FIG. 3. The spring attachment 90 includes a pair of spring legs 91 giving the spring bias to the cam wheels 80 and a center leg 92 to be secured to the outer face of the bracket 22, 23. The spring leg 91 is formed with a mouth 93 within which the cam wheel 80 fits loosely. Also as shown in FIG. 11, the cam wheel 80 fits loosely in a socket hole 95 formed in the bracket 22, 23 with the associated pin 81 resting on flanges 97 at opposite ends of a bearing hole 96 crossing the socket hole 95. The spring leg 91 engages at the circumference of the mouth 93 with the pin 81 so as to urge the cam wheel 80 towards the slider 70. However, this inwardly biased movement of the cam wheel 80 is restricted by engagement of the pin 81 with the flanges 97, thereby limiting a contacting pressure at which the cam wheel is pressed against the slider 70 and therefore giving an optimum contacting pressure between the cam wheel and the actuator for giving reliable oscillating movement to the actuator, while absorbing dimensional variations of the associated parts.

As shown in FIG. 9, the fixed blades 52 in the one hair-pinching unit 50 are staggered with respect to the fixed blades 52 in the other hair-pinching unit 50 along the longitudinal axis of the plucking head 30. That is, the gaps formed between each of the fixed blades and the two adjacent movable blades 62 in the one hair-pinching unit 50 are staggered to the gaps in the other hair-pinching unit 50. Thus, during one complete cycle of the plucking head 30, the gaps formed by the whole plucking head 30 can cover an intended area of the skin without leaving a substantial dead-zone not available for entrapping the hairs. The above staggered arrangement is realized only by the use of the hair-pinching unit 50 of the identical but specific configuration. That is, the frame 60, which determines the overall length of the unit 50, has different margins on opposite longitudinal ends, i.e., portions of different lengths respectively defined by the one outermost slit 66 and by the other outermost slit 66. Thus, the above staggered arrangement can be made by simply inserting the individual hair-pinching units 50 into the plucking cylinder 31 in opposite orientations.

Figure 10:
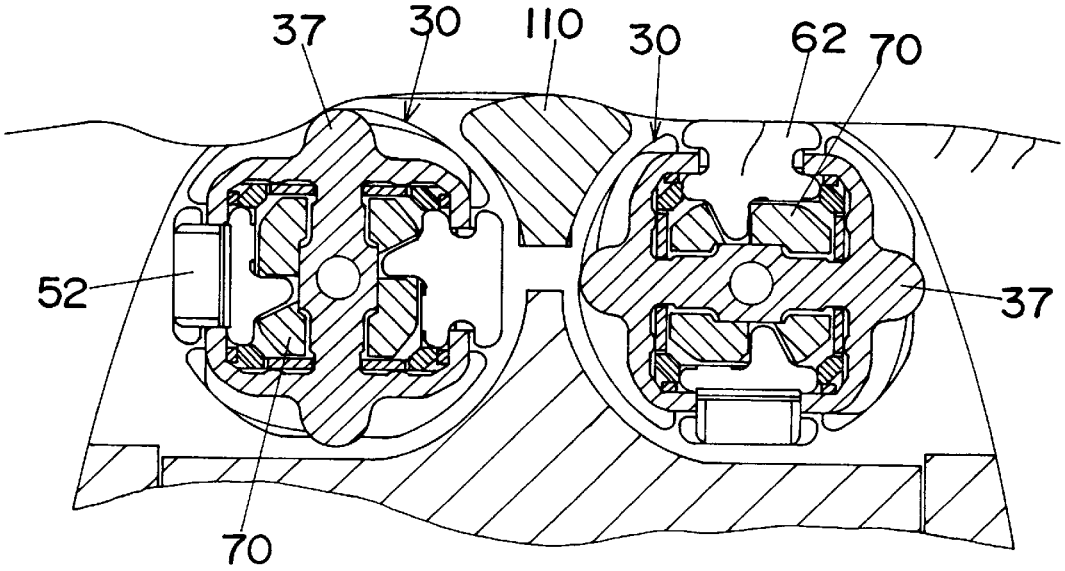
FIG. 10 is a sectional view of a top end of the epilating device.

As shown in FIGS. 2 and 10, the two plucking heads 30 are mounted in the head frame 20 in parallel with each other but at an angular displacement of 90° from each other such that, when the blades 62 of the one plucking head 30 come into the plucking position, the skin stretcher 37 of the other plucking head 30 comes in contact with the skin for stretching the skin prior to the subsequent hair plucking by the same head. Thus, the hair plucking is made alternately by the two plucking heads 30 at different timings. The two plucking heads 30 are driven to rotate in the opposite directions so that the hairs of different orientations as frequently seen in the armpit can be successfully entrapped and plucked by the two heads. The one plucking head 30 is drivingly connected to driven gear 120 through a first gear train composed of gears 124, 123, 122 and 121 while the other plucking head 30 is connected to the driven gear through a second gear train composed of gears 126, 125, 123, 122, and 121. Gears 32 and 124 of the first gear train leading to the one plucking head 30 and gears 32 and 126 of the second gear train leading to the other plucking head 30 are located on opposite ends of the head frame 20 so that noise and mechanical vibrations of the rotating gears can be distributed on opposite of the frame 20, and that frame 20 can have a substantially equal dimension on opposite of the heads 30.

A skin smoother 110 is located between the two plucking heads 30 for pressed contact with the skin confined between the two plucking heads 30. Thus, the skin smoother can avoid excessive elongation of the skin portion confined between the two heads and being pulled by the oppositely rotating heads, thereby alleviating pains of plucking the hairs.

Figure 12:
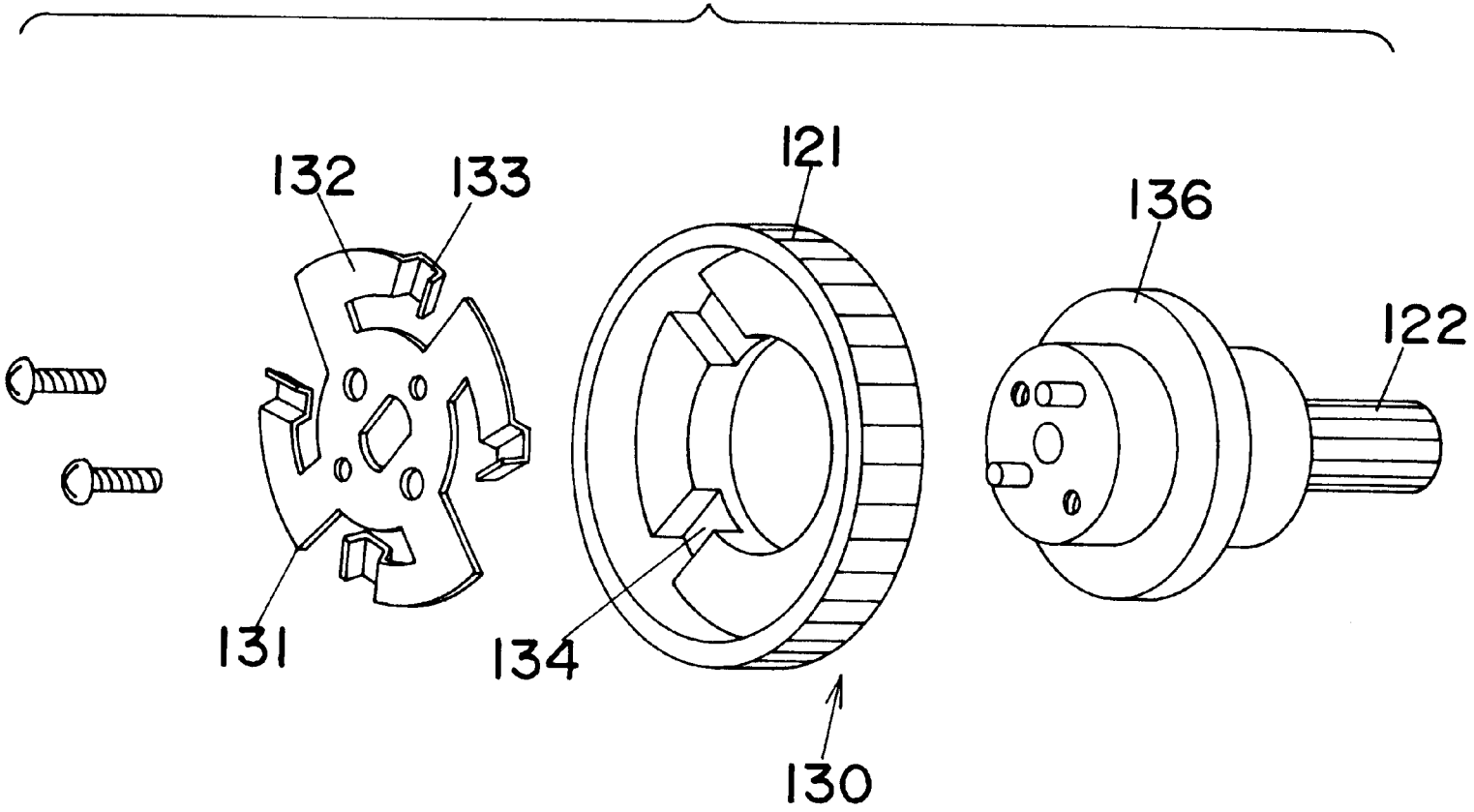
FIG. 12 is an exploded perspective view of an over-load clutch utilized in a transmission path of driving the plucking head.

An overload clutch 130 is provided across the gears 121 and 122 as a safeguard for protecting the motor and the transmission mechanism against possible entanglement of foreign matters in or around the plucking heads 30. As shown in FIG. 12, the clutch 130 is composed of the wheel gear 121 and a clutch plate 131 secured to a disk 136 at the one axial end of the gear 122. The clutch plate 131 includes a plurality of circumferentially spaced spring legs 132 each having at its free end a pawl 133. The pawl 133 are spring-biased into corresponding dents 134 in the bottom of the gear wheel 121 to establish the driving connection between the gears 121 and 122. When an excessive torque is required at the junction between the gears 121 and 122, the pawls 133 are caused to escape from the dents 134 against the bias of the spring legs, disengaging the driving connection between the gears 121 and 122.

Figure 13:
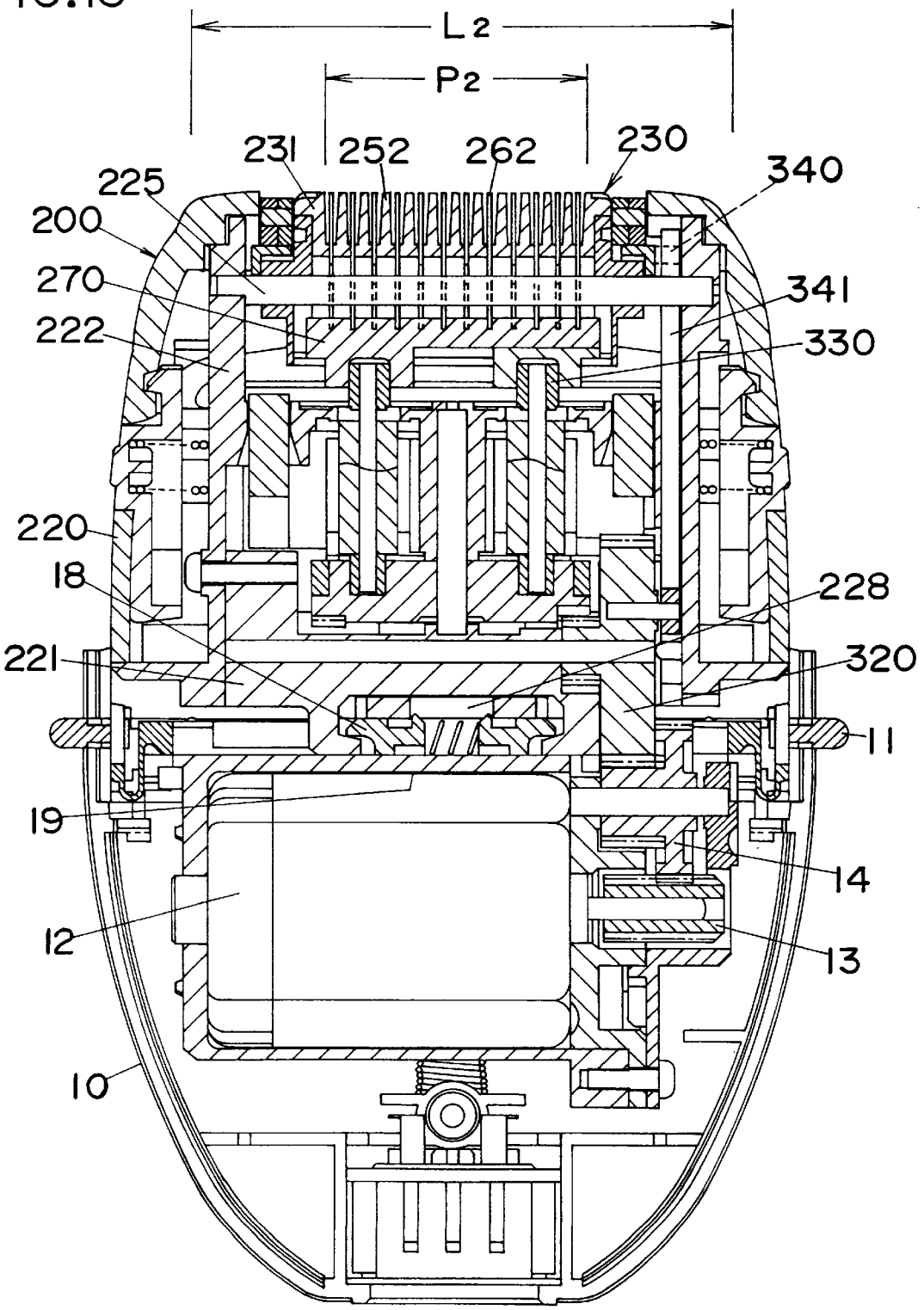
FIG. 13 is a vertical section illustrating an epilation module with another plucking head attached to a common base shell.

FIG. 13 shows another epilation module 200 which is also detachable to the common base shell 10. For the sake of clarity, the epilation module 100 shown in FIG. 1 is referred to as a first epilation module, and that of FIG. 13 is as a second epilation module 200. The second epilation module 200 is designed to be well adapted for removal of the body hairs on relatively large skin portions such as legs and arms, while the first epilation module 100 is for removal of the body hairs on the small restricted skin portion such as the armpits. A second head frame 220 mounts on its top a second plucking head 230 alone which has an effective plucking length (P2) greater than that (P1) of the plucking head 30 of the first epilation module 100. In this consequence, the second head frame 220 is shaped to have an enlarged top of which length (L2) is greater than that (L1) of the head frame 20 of the first epilation module 100. The second head frame 220 has a like bottom plate 221 with a catch recess 228 for detachable connection to the latches 18 on top of the base shell 10 and with a driven gear 320 for detachable driving connection to the drive gear 14.

Figure 14:
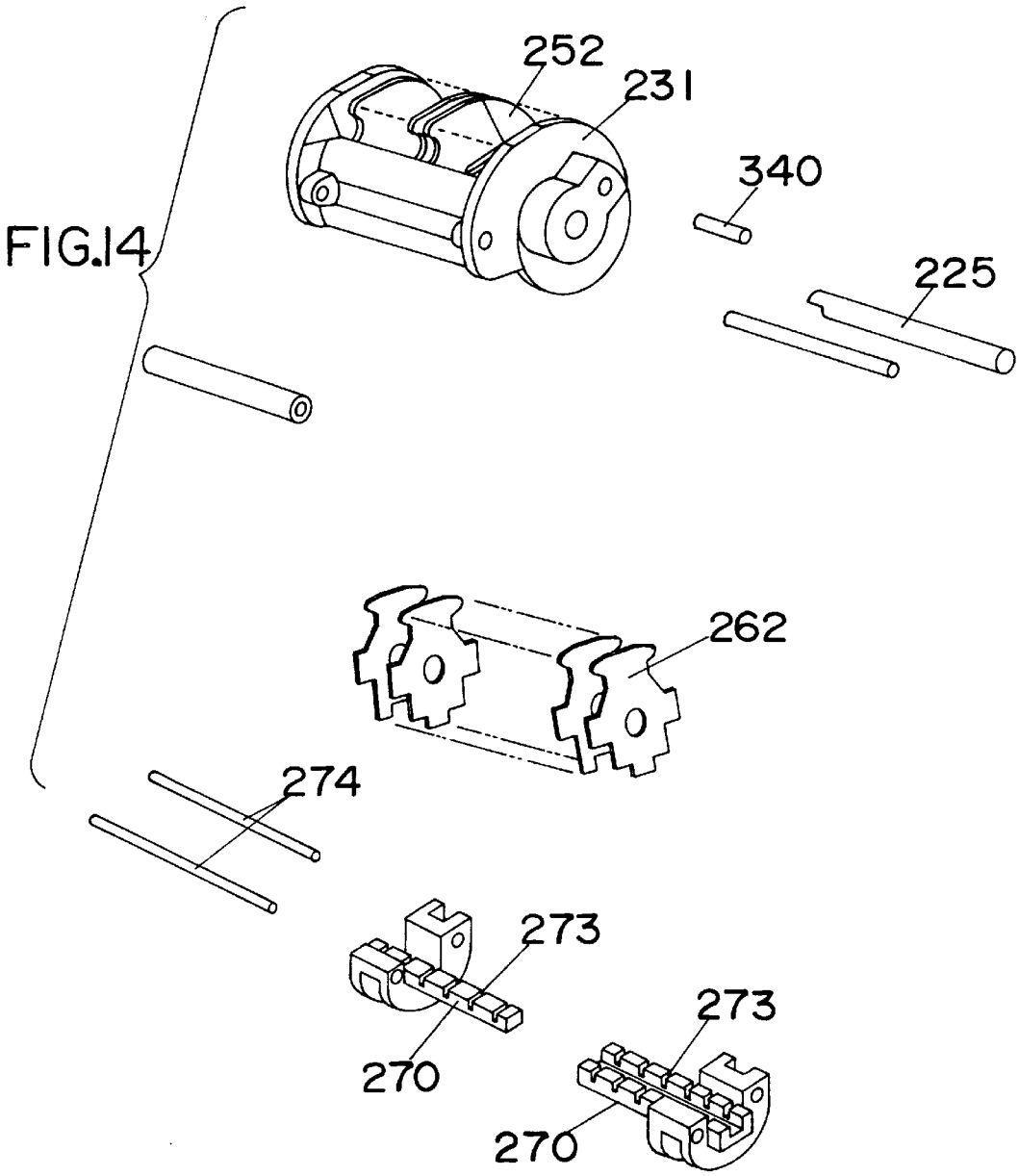
FIG. 14 is an exploded perspective view of the plucking head of FIG. 13.

The second plucking head 230 includes a plucking cylinder 231 which is supported by a center pin 225 and is driven to oscillate about its longitudinal axis. The cylinder 231 is molded to have a series of integrally formed fixed blades 252 arranged along a longitudinal axis of the cylinder, as shown in FIG. 14, and carries a series of movable blades 262. The movable blades 262 are also supported to the center pin 225 in such a manner as to be pivotable about an axis perpendicular to the length of the center pin. A pair of sliders 270 are supported also to the cylinder 231 by means of guide pins 274 to be slidable in the lengthwise direction of the cylinder 231. The lower ends of the movable blades 262 are anchored to notches 273 of the sliders 270 so that the movable blades 262 are caused to pivot for closing and opening the gaps between the movable and fixed blades as the sliders 270 are driven to oscillate in opposite directions from each other. For this purpose, the sliders 270 are drivingly connected to a pair of eccentric cam rollers 330 which translate the eccentric motion of the cam roller into the reciprocatory motion of the sliders. The cam rollers 330 are coupled though a gear mechanism to the driven gear 320 so as to be driven by the motor 12 to effect the above eccentric motion. The center pin 225, the cam rollers 330, and the associated gear mechanism are supported to a bracket 222 fixed to the bottom plate 221 of the head frame 220. The gap formed between the movable blade 262 and the fixed blade 252 of the second epilation module is set to be greater than the gap of the first epilation module.

Formed at one longitudinal end of the plucking cylinder 231 is a pin 340 which is linked through a crank lever 341 to the driven gear 320 so as to translate the rotary motion of the driven gear 320 into the oscillatory motion of the plucking cylinder 231 about its longitudinal axis or pin 225. The oscillatory motion of the plucking cylinder is synchronized with the reciprocatory motion of the sliders 270 such that, as the cylinder 231 moves in one direction to displace the blades from a retreated position in the head frame 220 to an exposed position on top of the frame, the movable blades 262 are caused to close the gaps for entrapping the hairs, and as the cylinder turns in the reverse direction to displace the exposed position to the retracted position, the movable blades are kept closed with the fixed blades for plucking the hairs pinched in the closed gaps in that direction followed by the movable blades are opened to be ready for the subsequent hair plucking. In this sense, the plucking head 230 of the second epilation module 200 operates to pluck the hairs in one direction, in contrast to the first epilation module 100 in which the bi-directional hair plucking is realized by the two oppositely rotating plucking heads 30. With the provision of the first and second epilation modules 100 and 200, the user can select one of the epilation modules depending upon the skin portions for making an optimum hair plucking.

Figure 15:
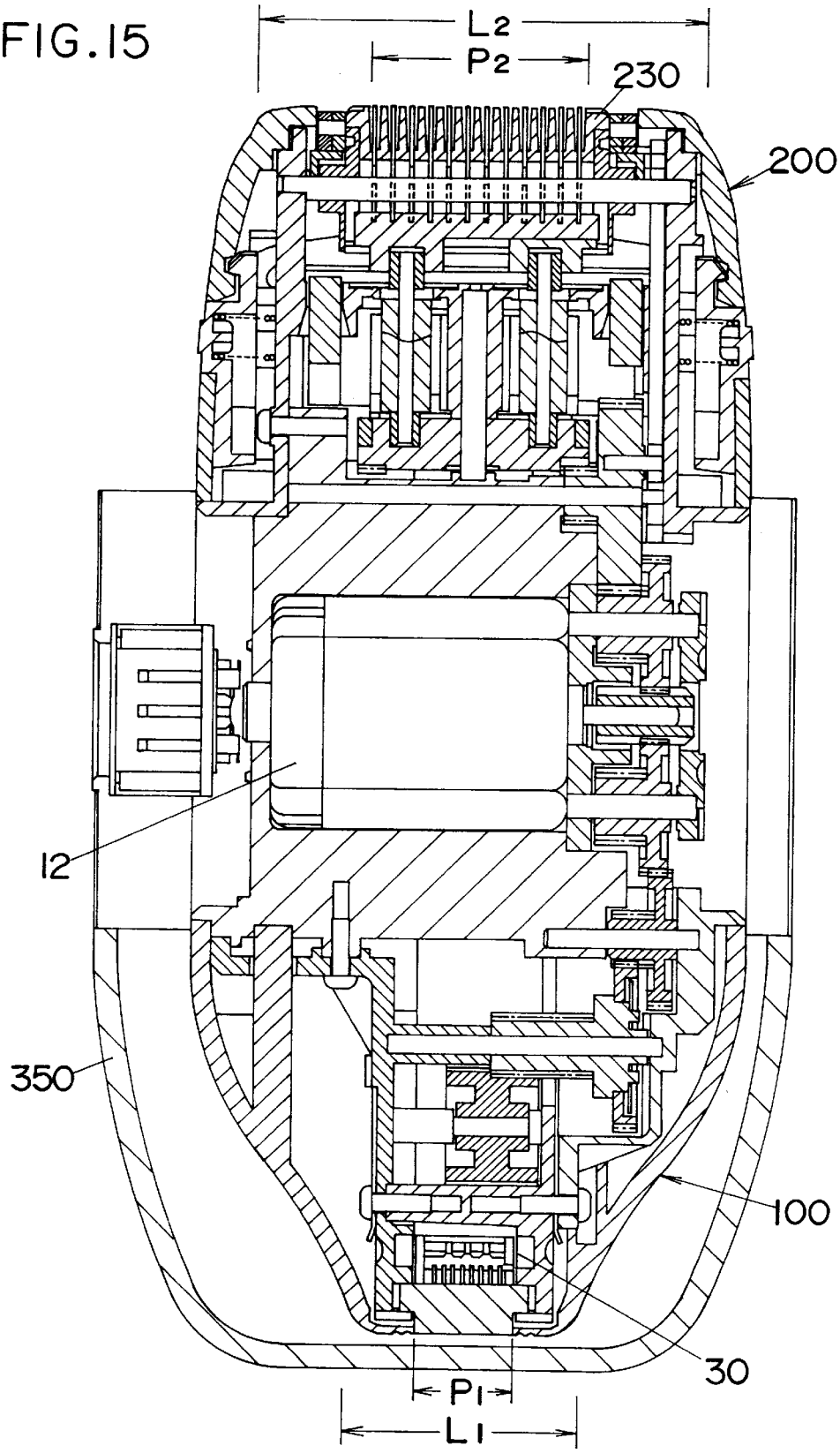
FIG. 15 is a vertical section of an epilating device in accordance with another preferred embodiment of the present invention.

FIG. 15 shows another preferred embodiment of the present invention which is equipped with both of the first and second epilation modules 100 and 200 fixedly mounted on the upper and lower ends of the base shell 10. The plucking heads 30 and 230 are respectively of substantially the identical structures as in the previous embodiments, and therefore like parts are designated by like reference numerals. The two heads 30 and 230 are energized by the common motor 12. A detachable cover 350 is fitted over either one of the modules 100 and 200 on the base shell 10 to conceal the other module not in use.

Although the above embodiments illustrate that the plucking heads 30 of the first epilation module 100 rotates about their respective longitudinal axes and that the plucking head 230 of the second epilation module 200 oscillates about its longitudinal axis, the present invention should not be limited in this particular aspect and could be easily modified such that either of the plucking heads of the first and second epilation modules rotate or oscillate as necessary.

What is claimed is:

1. An epilating device for removal of body hairs, said device comprising:

a single housing to be grasped by the hand of a user, said housing including a drive source; and a first epilation module carried on said housing and having on its top end a first plucking head which is driven by said drive source to effect plucking of the body hairs, said first plucking head having a length (P1) which defines therealong a first epilation zone; wherein a second epilation module carried on said housing and having on its top end a second plucking head which is driven by said drive source to effect plucking of the body hairs, said second plucking head having a length (P2) which defines therealong a second epilation zone;

said first and second epilation modules being shaped respectively to have individual top ends of different external dimensions (L1, L2) along said lengths of said first and second plucking heads and to have said first and second epilation zones of different lengths (P1, P2).

2. The epilating device as set forth in claim 1, wherein said first and second epilation modules are detachable to said housing so that said first and second epilation modules are selectively carried to said housing.

3. The epilating device as set forth in claim 2, wherein said housing includes a drive gear connected to said drive source, said first epilation module includes a first driven gear which comes into detachable meshing engagement with said drive gear so as to actuate said first plucking head for plucking of the hairs, and said second epilation module includes a second driven gear which comes into detachable meshing engagement with said drive gear so as to actuate said second plucking head for plucking of the hairs.

4. The epilating device as set forth in claim 2, wherein each of said first and second plucking heads includes a series of blades arranged to have a gap between the adjacent blades for pinching the hairs in said gap, and the gap of the blades of the first plucking head being made smaller than that of the second plucking head.

5. The epilating device as set forth in claim 2, wherein said first epilation module includes a pair of said first plucking heads disposed to be capable of simultaneous contact with a skin of the user, while said second epilation module includes only one said second plucking head, said first plucking head having said first epilation zone of which length is smaller than that of said second epilation zone of said second plucking head.

6. The epilating device as set forth in claim 5, wherein said two first plucking heads are arranged to effect the plucking of the hairs at different timings.

7. The epilating device as set forth in claim 5, wherein each of said first plucking heads comprises a plucking cylinder having a longitudinal axis and being provided with at least two rows of blades arranged along said longitudinal axis for pinching the hairs between the adjacent blades of each row, said plucking cylinder being driven to move about said longitudinal axis for plucking from the skin the hairs pinched between the blades, said plucking cylinder further including a skin stretcher for smoothing the skin, and said skin stretcher in each of said plucking cylinders being disposed between said two rows of the blades about said longitudinal axis around the circumference of said plucking cylinder.

8. The epilating device as set forth in claim 7, wherein differential means is provided to move said plucking cylinders about the individual longitudinal axes in such a manner as to effect the pinching of the hairs by one of the plucking cylinders while bringing said skin stretcher of the other plucking cylinder into contact with the skin at the same time.

9. The epilating device as set forth in claim 1, wherein said first epilation module includes a pair of said first plucking heads arranged in parallel with one another and each having a first longitudinal axis to be movable thereabout for plucking the hairs, said second epilation module includes only one said second plucking head having a second longitudinal axis to be movable thereabout for plucking the hairs, the pair of said first plucking heads being driven to move respectively about said first longitudinal axes in opposite directions at the time of plucking the hairs, and the second plucking head being driven to move about said second longitudinal axis only in one direction at the time of plucking the hairs.

10. The epilating device as set forth in claim 1, wherein said first epilation module includes a pair of said first plucking heads arranged in parallel with each other and each having a first longitudinal axis to be movable thereabout for plucking the hairs, each of said first plucking heads being provided with a series of blades including at least one movable blade which is cooperative with the adjacent one of said blade to form therebetween a gap and is caused to close and open the gap for pinching the hairs in said gap, each of said first plucking heads being driven to move about said first longitudinal axis for plucking from the skin the hairs pinched in said gap, a drive mechanism being provided to move the individual first plucking heads respectively about said first longitudinal axes for plucking the hairs, said drive mechanism comprising a single motor and a pair of separate transmission gear trains each leading from said motor to each one of said individual first plucking heads, and said separate transmission gear trains being disposed on opposite ends of said first plucking heads with respect to said longitudinal axes thereof.

11. The epilating device as set forth in claim 1, wherein said first epilation module includes a pair of said first plucking heads arranged in parallel with one another and each having a first longitudinal axis to be movable thereabout for plucking the hairs, each of said first plucking heads being provided with a series of blades including at least one movable blade which is cooperative with the adjacent blade to form therebetween a gap and is caused to close and open the gap for pinching the hairs in said gap, each of said first plucking heads being driven to move about said first longitudinal axis for plucking from the skin the hairs pinched between said movable blade and the adjacent blade, a drive mechanism being provided to move said individual first plucking heads respectively about said first longitudinal axis, said drive mechanism including first and second gear trains leading commonly from said drive source to said respective first plucking heads, said first gear trains including a number of gears which differs by an odd number from that of said second gear trains so that said first plucking heads are driven to move in the opposite directions about the first longitudinal axes.

12. The epilating device as set forth in claim 11, wherein a skin smoother is provided between said first plucking heads to come into contact with the skin of a user for pressing a portion of the skin confined between said first plucking heads.

13. The epilating device as set forth in claim 1, wherein an overload clutch is provided in a drive transmission path which leads from said drive source to said first plucking head.

14. The epilating device as set forth in claim 1, wherein said first plucking head comprises:

a plucking cylinder having a longitudinal axis and movable about said longitudinal axis;

a holder carrying a series of blades arranged side-by-side along an axis parallel to said longitudinal axis, said blades including at least one movable blade which is cooperative with the adjacent one of said blades to form a gap therebetween, said holder having at least one fulcrum for pivotally supporting said movable blade so that said movable blade pivots about a pivot axis perpendicular to said longitudinal axis to close and open said gap for pinching the hairs therebetween;

an actuator reciprocating along said longitudinal axis and connected to pivot said movable blade for closing and opening said gap; and drive means for driving said plucking cylinder to move about said longitudinal axis for plucking the hair from the skin, said holder and said actuator being integrated into a hair-pinching unit which is mounted to said plucking cylinder.

15. The epilating device as set forth in claim 14, wherein said plucking cylinder carries at least two said hair-pinching units (50) which are circumferentially spaced about said longitudinal axis in parallel relation to each other, said blades in each of said hair-pinching units being composed of at least two pairs of movable blades and at least two fixed blades with one of said fixed blades being interposed between the two movable blades in each pair to form said gap between each of said movable blades and said fixed blade, and said fixed blades in one of said hair-pinching units being staggered along said longitudinal axis with respect to said fixed blades in the other hair-pinching unit.

16. The epilating device as set forth in claim 14, wherein said plucking cylinder carries at least two said hair-pinching units which are circumferentially spaced about said longitudinal axis in parallel relation to one another, and a toggle element being provided to interlock the actuators such that the actuator's movement of closing said gap in one hair-pinching unit is transmitted the actuator's movement of opening said gap in the other hair-pinching unit.

17. The epilating device as set forth in claim 1, wherein said first plucking head comprises a plucking cylinder having a longitudinal axis and movable thereabout, said plucking cylinder being provided with a series of blades which are arranged side-by-side along an axis parallel to said longitudinal axis and include at least one movable blade which is cooperative with the adjacent one of said blades to form a gap therebetween, said movable blade being supported to pivot about a pivot axis perpendicular to said longitudinal axis so as to close and open said gap for pinching the hairs in said gap and releasing the hairs therefrom, said plucking cylinder including an actuator which is driven to reciprocate along said longitudinal axis and connected to move said movable blade so as to open and close said gap for pinching the hairs in the gap, said actuator engaging with a cam wheel and being caused by said cam wheel to reciprocate for closing said gap in response to the movement of said plucking cylinder about said longitudinal axis, a spring being provided to bias said cam wheel into pressed contact with said actuator, and restricting means being provided to restrict the bias of said spring for limiting a contacting pressure at which said cam wheel is pressed against said actuator.

18. The epilating device as set forth in claim 1, wherein said first and second epilation modules are fixed to opposite ends of said housing.

* * * * *